US008783803B1

(12) United States Patent
Clark

(10) Patent No.: US 8,783,803 B1
(45) Date of Patent: Jul. 22, 2014

(54) METHODS AND APPARATUS FOR REUSING AND RECYCLING PRE-PRINTED MEDIA

(75) Inventor: Gordon R. Clark, Meridian, ID (US)

(73) Assignee: Marvell International Ltd., Hamilton (BM)

( * ) Notice: Subject to any disclaimer, the term of this patent is extended or adjusted under 35 U.S.C. 154(b) by 199 days.

(21) Appl. No.: 13/282,320

(22) Filed: Oct. 26, 2011

Related U.S. Application Data

(60) Provisional application No. 61/407,290, filed on Oct. 27, 2010.

(51) Int. Cl.
*B41J 29/38* (2006.01)
*B41J 2/175* (2006.01)
*B41J 2/18* (2006.01)

(52) U.S. Cl.
USPC ..... 347/9; 347/16; 347/19; 347/85; 347/89

(58) Field of Classification Search
USPC ..... 347/9, 16, 37, 19, 85, 36, 23, 89
See application file for complete search history.

(56) References Cited

U.S. PATENT DOCUMENTS

2007/0109349 A1* 5/2007 Tanaka et al. ..... 347/37
2008/0273073 A1* 11/2008 Oakley ..... 347/103

* cited by examiner

*Primary Examiner* — Jason Uhlenhake

(57) ABSTRACT

A method for printing on a print medium, where the method comprises receiving, into a printing apparatus, a print medium containing preprinted information located on a first portion of the print medium. The method further comprises the printing apparatus printing information on a second portion of the print medium, wherein the second portion is different from the first portion. The method also comprises the printing apparatus marking an indication on the print medium at or near the first portion of the print medium, wherein the indication identifies the preprinted information located on the first portion of the print medium as being distinct from the information located on the second portion of the print medium.

17 Claims, 5 Drawing Sheets

METHODS AND APPARATUS FOR REUSING AND RECYCLING PRE-PRINTED MEDIA

CROSS-REFERENCES TO RELATED APPLICATIONS

The present disclosure claims priority to U.S. Patent Provisional Application No. 61/407,290 filed on Oct. 27, 2010, the entire disclosure of which is hereby incorporated by reference in its entirety except for those sections, if any, that are inconsistent with this disclosure.

TECHNICAL FIELD

The present disclosure relates to printing on a media, and more particularly, to reusing and recycling pre-printed media.

BACKGROUND

In tough economic times or otherwise, many organizations such as, for example, educational organizations, charitable organizations, non-profit organizations and even many businesses commonly look for ways to reduce costs. One way to reduce costs is to reuse or "recycle" various items that have been previously used. For example, a print media—e.g., paper—generally has two surfaces on which printing and writing can be performed. Printers are often used to print information only on a single side of a sheet of paper, and thereafter, the printed sheet of paper is eventually thrown away or dispensed within a recycling bin.

SUMMARY

The present disclosure provides a method for printing on a print medium, where the method comprises receiving, into a printing apparatus, a print medium containing preprinted information located on a first portion of the print medium. The method further comprises the printing apparatus printing information on a second portion of the print medium, wherein the second portion is different from the first portion. The method also comprises the printing apparatus marking an indication on the print medium at or near the first portion of the print medium, wherein the indication identifies the preprinted information located on the first portion of the print medium as being distinct from the information located on the second portion of the print medium.

DETAILED DESCRIPTION OF DISCLOSED EMBODIMENTS

Figure 1:
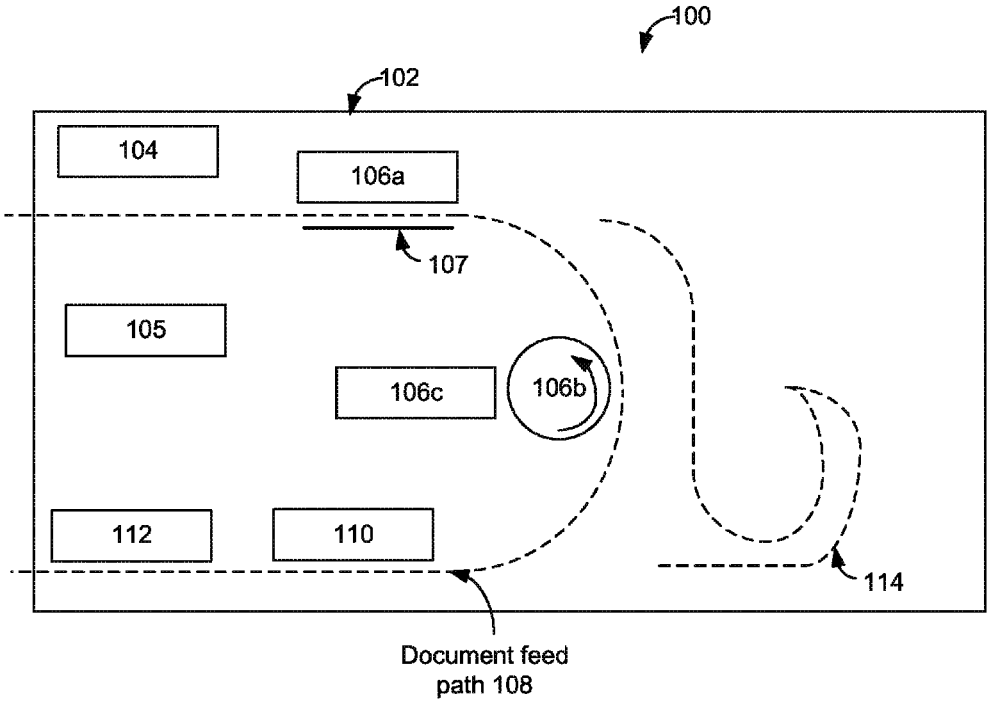
FIG. 1 schematically illustrates a printing apparatus.

FIG. 1 illustrates an example of a printing apparatus 100. The printing apparatus 100 includes a housing 102, a control panel 104, a controller 105 and a printing mechanism 106 located adjacent a document feed path 108. In order to print on a print medium 107 such as, for example, paper, a sheet of paper 107 is moved through the printing apparatus 100 along the document feed path 108 and, depending upon the type of printing apparatus 100, past at least one of the printing mechanisms 106*a, b* and *c*, which causes an image to be printed on the paper 107 to thereby create a print document. The image can include, for example, printed letters, pictures, graphs, tables, etc. In some embodiments, the printing mechanism 100 also includes one or more sensors 112, as will be described further herein.

As known in the art, there are many types of printing apparatuses. For example, one type of well known printing apparatus 100 is an ink printer, such as, for example, an ink jet printer, a bubble printer, etc. For example, in an ink jet printer, paper 107 is fed along the document feed path 108 past the printing mechanism 106*a*, which is in the form of at least one or more ink jets. The ink jets deposit ink on the paper 107 to create a printed image.

Another type of printing apparatus 100 known in the art is a laser printer. As is known, in a laser printer, paper 107 is fed past a rotating drum 106*b* that has been charged and is covered in toner at various points due to those points being charged differently by a laser or one or more light emitting diodes (LEDs). The toner is included within a hopper is charged oppositely with respect to the points on the drum where toner is desired. The paper 107 is oppositely charged with respect to the toner, thereby causing the toner to move from the drum to the paper 107. A heating element is then used to melt the toner into the paper 107 to create a printed image. Thus, the printing mechanism 106*c* for a laser printer includes at least the rotating drum 106*b*, the laser or LEDs, the hopper and the heating element.

The printing apparatus 100 may also include a second printing mechanism 110 for printing an invalid mark 200 as will be described further herein. Additionally, the printing apparatus 100 may be a dual-sided printer that can print on both sides of the paper without manually loading the paper into the printing apparatus 100 twice. Such a printing apparatus 100 may include, for example, a duplex paper path 114 that routes the paper 107 through the printing apparatus 100 twice and flips it so that both sides of the paper 107 can be printed on.

In both types of printers, various components such as, for example, belts, rollers, pulleys, etc. can be used to move paper through the printing apparatus along the document feed path. Such components and various arrangements are well known in the art and thus, will not be described further herein.

In accordance with various embodiments of the present disclosure, a paper that has already been partially used, i.e., the paper includes at least a portion of preprinted information, for example, preprinted material (printed by a printer or a copier, for example), prewritten material, predrawn material, etc., is reused for a print job within a printing apparatus 100. As the paper is moved through the printing apparatus 100 along the document feed path 108, an invalid mark is placed at or near the preprinted information to indicate that preprinted information is not part of a current or valid print job.

Figure 2B:
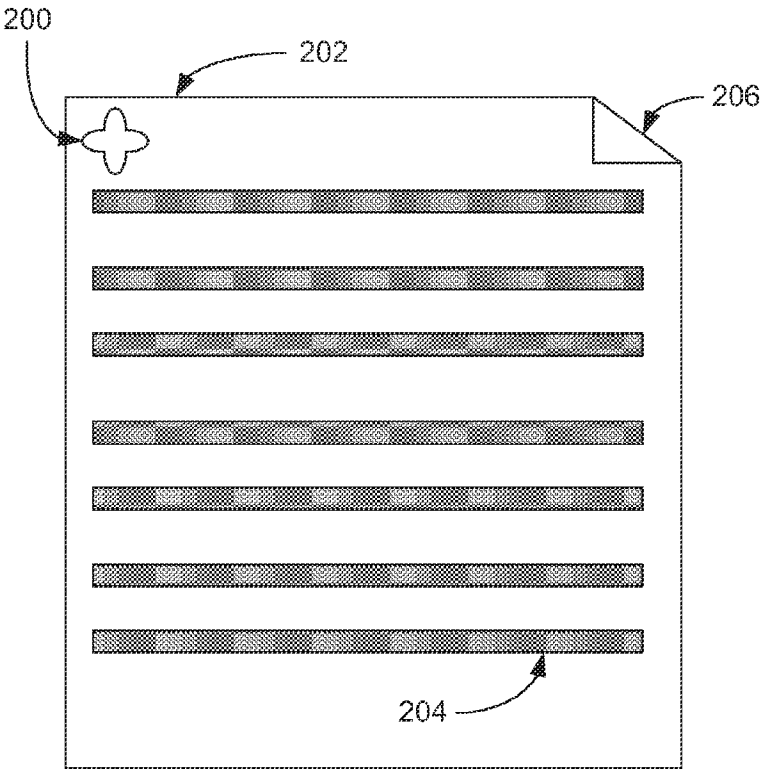
FIGS. 2A-2C schematically illustrate a print medium that includes preprinted material and an invalid mark.
Figure 2A:
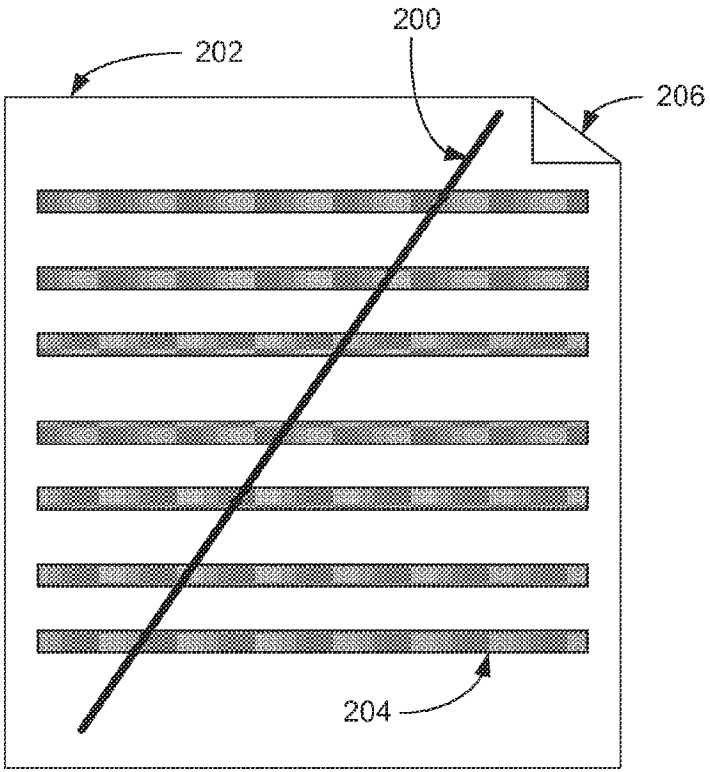

Referring to FIG. 2A, an invalid mark 200 can be in the form of, for example, a line 200 (such as a diagonal line) across the side of a print medium, i.e. a sheet of paper 202, that includes preprinted information 204 to indicate that that side of the paper 202 is no longer valid i.e., that side of the paper 202 is invalid and the side 206 of the paper 202 is valid.

Additionally, referring to FIG. 2B, the invalid mark 200 can be in the form of a stamp (or a simple marking) that is printed or stamped on the side of the paper 202 that includes the preprinted information 204 to indicate that that side of the paper 202 is no longer valid i.e., that side of the paper 202 is invalid. The side 206 of the paper 202 is valid for a printing operation. The invalid mark 200 in the form of a stamp can be printed at or near the preprinted information 204. The invalid mark 200 can be in the form of some type of image that can indicate that this procedure is an ecologically friendly procedure since the paper 202 is a piece of paper that has been previously partially used and is being reused prior to being recycled.

Figure 2C:
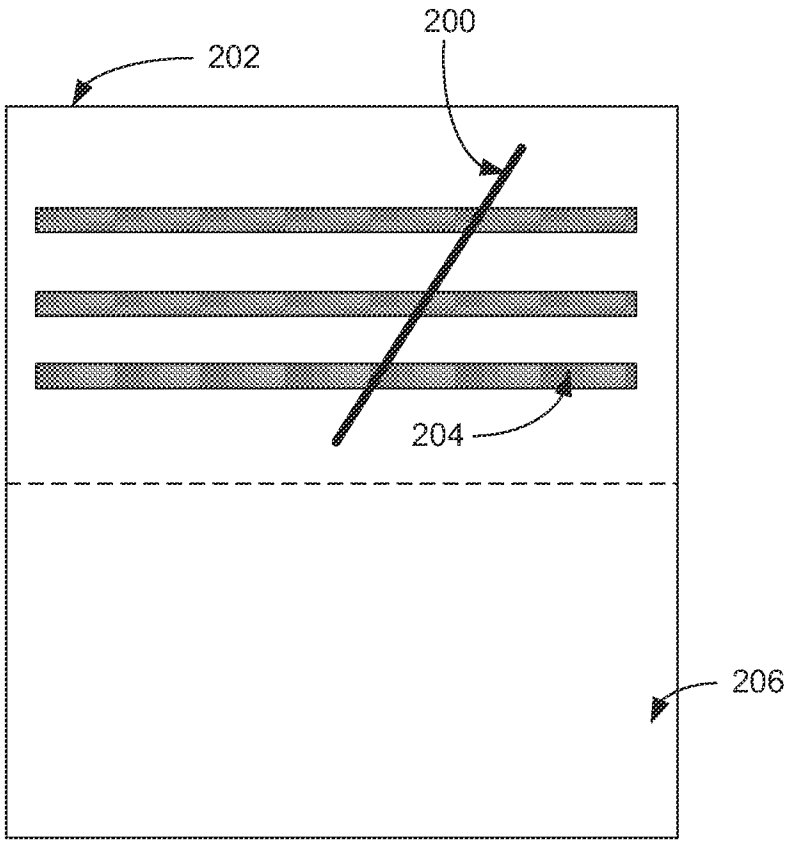

FIG. 2C illustrates a sheet of paper 202 that includes preprinted information 204 on only a portion of a side of the paper 202. Thus, the invalid mark 200 is placed at or near the preprinted information 204. The invalid mark 200 can be, for example, a line or a stamp (or a simple marking) as previously described. The invalid mark 200 provides an indication that portion 206 of the paper 202 is valid for a printing operation.

Referring to FIGS. 1 and 2A-C, in accordance with an embodiment, if the printing apparatus 100 is in the form of an ink printer, then the invalid mark 200 can be placed at or near the invalid portion of the paper 202 using the printing mechanism 106, which can be in the form of, for example, one or more ink jets. If the printing apparatus 100 is a single sided printer, i.e. only prints on one side of paper during a single pass through the printing apparatus, then the paper 202 can be fed through the printing apparatus 100 twice, with a user selecting an invalid print option (e.g., "recycle 1-side") on the control panel 104 to indicate to the controller 105 that the paper 202 is currently being fed through the printing apparatus 100 such that an invalid side of the paper 202 is available for printing and therefore, the invalid mark 200 should be printed on the current side available for printing. Thus, the user is providing an indication to the printing apparatus that the paper includes preprinted information 204 and thus, the printing apparatus is manually sensing that the paper includes preprinted information 204. The user can then reverse the paper 202 and feed it through the printing apparatus 100 a second time. The user can select a valid print option on the control panel 104 to indicate to indicate to the controller 105 that the paper 202 is currently being fed through the printing apparatus 100 such that the valid side, i.e. side 206, of the paper 202 is available for printing and a valid print job should be printed on the paper 202. The valid print job could also occur automatically upon feeding the paper 202 through the printing apparatus 100 a second time. The order of operations could also be reversed.

During the invalid print operation, the printing apparatus 100 can utilize a fast draft or reduced quality mode for printing the invalidated mark if the printing mechanism 106 is being used to print the invalid mark 200. The printing apparatus 100 can then switch back to the original print quality mode for the valid print job. If desired, the order of the printing can be reversed and the valid print job can be printed first and the invalid mark 200 can be printed second. If the printing apparatus 100 is a laser printer, then the invalid mark 200 can be printed using a toner-save print mode for the invalid mark printing operation.

If the printing apparatus 100 is a dual sided printer, i.e., a printer that can print on both sides of the paper by feeding a paper 202 into the printer once, then, in an embodiment, the paper 202 will be automatically rerouted through the printer a second time, with one side being printed with the invalid mark 200 and the other side being printed with a currently valid print job. Duplex paper path 114 (an example of which is illustrated in FIG. 1) can be included along the document feed path 108 within the printing apparatus 100 (or can be added to the document feed path 108) to allow the paper 202 to be rerouted through the printing apparatus 100 a second time. Additionally, there are feed mechanisms known in the art that can automatically mechanically route the paper 202 through the printing apparatus 100 twice. A user loads the paper 202 into the printing apparatus 100 with the side including the preprinted information 204 oriented properly so the printer can properly provide the invalid mark 200. The paper can also be loaded into one or more paper feed trays (not illustrated) with the side including the preprinted information 204 oriented properly so the printer can properly provide the invalid mark 200. The user can also manually indicate on the control panel 104 which side of the paper 202 includes the preprinted information.

In accordance with various embodiments, as mentioned with reference to FIG. 1, the printing apparatus 100 can include a second printing mechanism 110 along the document feed path 108, as is known in the art. The second printing mechanism 110 is generally located on the opposite side of the document feed path 108 with respect to the first printing mechanism 106 and can be the form of, for example, a single ink jet, a minimal resolution print head, a felt base marker, a stamp or some type of smear marking technology. The paper 202 can be fed through the printing apparatus 100 with the preprinted or used side adjacent to the second printing mechanism 110 such that the second printing mechanism 110 can mark the side of the paper with an invalid mark 200. As the paper 202 moves past the first printing mechanism 106, then the valid print job can be performed on the side 206 of paper 202. The roles of the two printing mechanisms 106, 110 can be reversed such that the second printing mechanism 110 prints the current valid print job and the first printing mechanism 106 prints the invalid mark 200.

If the preprinted information 204 and the valid portion 206 of the paper are on the same side of the paper 202 (as illustrated in FIG. 2C), then the paper may not need to be rerouted through the printing apparatus 100 a second time depending upon the configuration of the printing apparatus 100.

Figure 3:
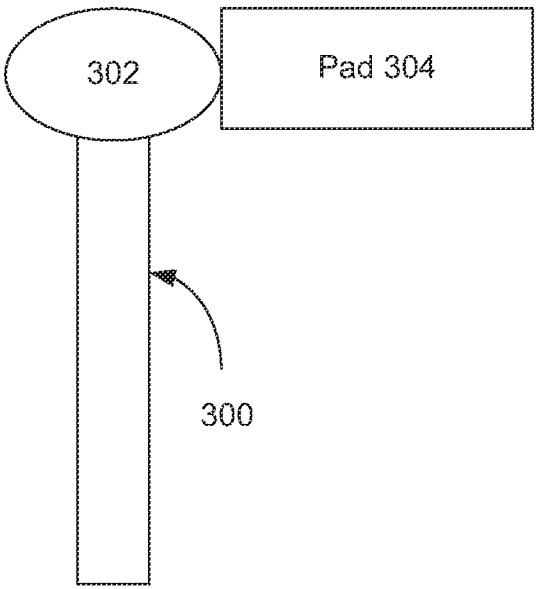
FIG. 3 schematically illustrates an example of a second printing mechanism for use with a printing apparatus to print an invalid mark.

Referring to FIG. 3, in accordance with various embodiments, the second print mechanism 110 can be in the form of an automated mechanical arm 300 that includes a stamp 302 that can stamp the invalid side of the paper 202 with the invalid mark 200. The arm 300 can obtain ink from a stamp pad 304. As is known, in ink jet printers, the ink jet heads are periodically cleaned in a wiping fashion with a cleaning mechanism (not illustrated). Thus, if the printing apparatus 100 is an ink jet printer, then the ink wiped from the ink jet heads can be utilized to provide ink for the stamp pad 304.

Figure 4:
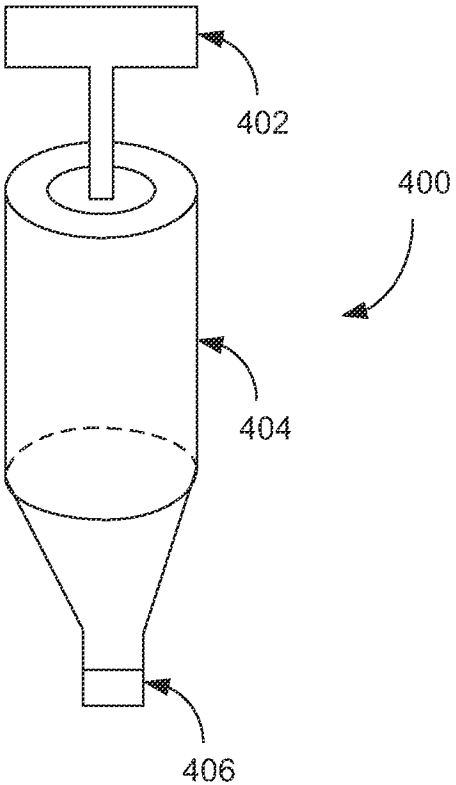
FIG. 4 schematically illustrates another example of a second printing mechanism for use with a printing apparatus to print an invalid mark.

Referring to FIG. 4, in another embodiment, the second printing mechanism 110 can be in the form of a marking apparatus 400. In one embodiment, the ink cleaned from the ink jet heads can be supplied via conduit 402 to a reservoir 404, for example an air tight bag, that can be used to feed a large dot-size print head 406 to thereby print the invalid mark 200 on the invalid side of the paper 202. In another embodiment, the ink can also be cleaned into the reservoir 404, in the form of a self sealing felt cartridge in this embodiment, that can be used as a felt marker to either move along the invalid side of the paper 202 or to be moved along the invalid side of the paper 202. The print head 406 is replaced with a felt marker type tip in such an embodiment.

If the printing apparatus 100 is a laser printer, then a transfer belt (not shown) is generally included with the laser printer, as is known in the art. The transfer belt can be utilized to move the paper 202 to the printing mechanism 106. In an embodiment, the transfer belt can also be utilized to move the paper 202 past a second printing mechanism 110 included in the laser printer. Additionally, in laser printers, toner is periodically cleaned from the drum. In an embodiment, this used toner can be accumulated such that it can be placed on the transfer belt, thereby marking the side of the paper 202 adjacent to the transfer belt as the invalid side of the paper 202.

The printing apparatus 100 can also include one or more sensors or scanning units 112 that sense that a side of the paper 202 includes preprinted information 204. Thus, in an invalid or recycled mode of operation for the printing apparatus 100, if the sensors 112 detect preprinted information 204, then the printing apparatus 100 automatically realizes that the portion of the paper 202 moving past the sensors 112 is the invalid portion of the paper 202 and therefore, the printing apparatus 100 can automatically mark that portion of the paper 202 at or near the preprinted information 204. If the printing apparatus 100 is a dual-sided or two sided printing apparatus, then the paper 202 can be rerouted through the printing apparatus 100 so that the valid print job can be performed on the valid side 206 of the paper 202. If the printing apparatus 100 is a single sided printer, then the document is manually flipped over and fed back through the printing apparatus so that the valid print job can be performed on the valid side 206 of the paper 202. If the preprinted information 204 and the valid portion 206 of the paper are on the same side of the paper 202 (as illustrated in FIG. 2C), then the paper may not need to be rerouted through the printing apparatus 100 a second time depending upon the configuration of the printing apparatus 100.

Accordingly, the present disclosure provides a printing apparatus that allows for various types of invalid marks to be printed on a print medium that can be utilized to help determine very quickly a wrong or invalid side or portion of printed material on the print medium. The invalid mark can be static such as, for example, a simple mark, i.e., a line, through most of the invalid side. Likewise, the static invalid mark can be used to invalidate only a portion of the invalid side in case a portion of the invalid side can still be used for future or current print jobs. The invalid mark can also be dynamic in that a sensor can be used to determine a starting position of invalid print information and can print the invalid mark at or near the location that includes the invalid print information. Thus, by marking a portion of the print medium with the invalid mark, an indication is provided at or near the portion to identify the preprinted information on that portion as being distinct from the information located on another portion of the print medium.

Figure 5:
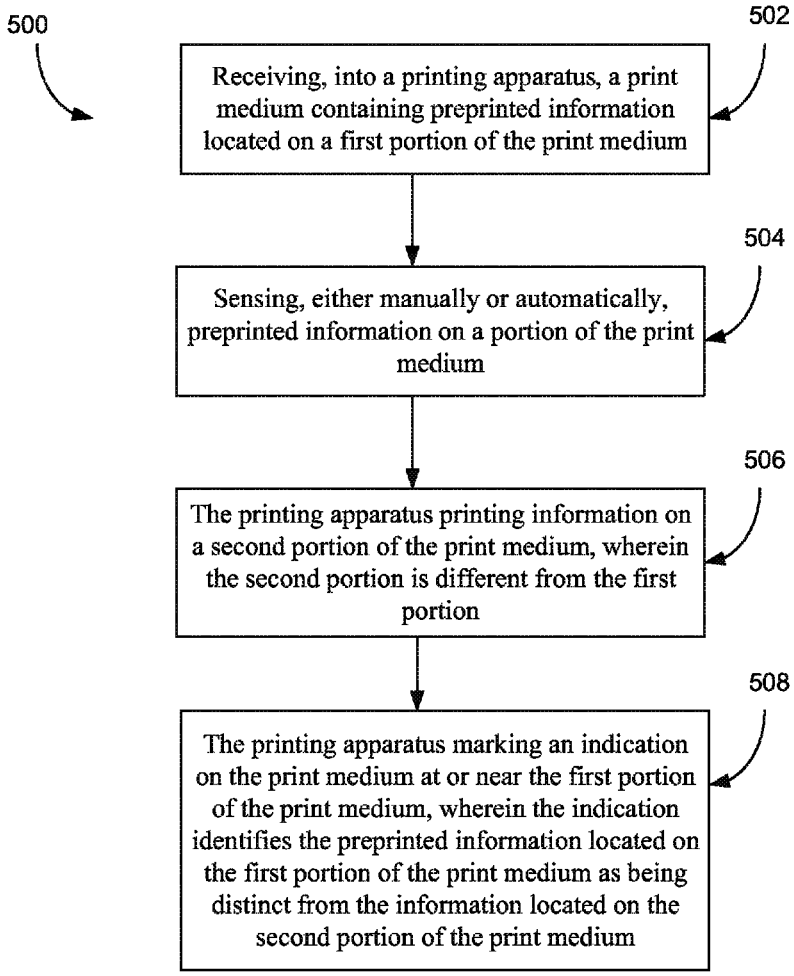
FIG. 5 is a flow chart that describes a printing operation for printing an invalid mark and a valid print job on a print medium that includes preprinted material.

Thus, with reference to FIG. 5, a method 500 includes receiving, into a printing apparatus, a print medium containing preprinted information located on a first portion of the print medium. In some embodiments, the method 500 includes, at 504, sensing, either manually or automatically, preprinted information on a portion of the print medium. The method 500 further includes, at 506, the printing apparatus printing information on a second portion of the print medium, wherein the second portion is different from the first portion. At 508, the method 500 includes the printing apparatus marking an indication on the print medium at or near the first portion of the print medium, wherein the indication identifies the preprinted information located on the first portion of the print medium as being distinct from the information located on the second portion of the print medium.

Various operations may have been described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

The description may use the terms "embodiment" or "embodiments," which may each refer to one or more of the same or different embodiments. Furthermore, the terms "comprising," "including," "having," and the like, as used with respect to embodiments, are synonymous.

Although certain embodiments have been illustrated and described herein, a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. For example, although the printing techniques are described primarily in the context with paper, other types of print media may be used—for example, transparencies, envelopes, coated paper, photo paper, labels, and so on. Therefore, it is manifestly intended that embodiments be limited only by the claims and the equivalents thereof.

What is claimed is:

1. A method performable by a printer for printing information on a print medium, wherein the printer comprises one or more ink jet heads configured to deposit ink onto the print medium in order to print the information on the print medium, the method comprising:

receiving, into the printer, the print medium, wherein the print medium contains preprinted information located on a first portion of the print medium; and the printer (i) depositing ink, via the one or more ink jet heads, to print the information on a second portion of the print medium, wherein the second portion is different from the first portion, and wherein a residual amount of ink remains on the one or more ink jet heads based on the ink being deposited through the one or more ink jet heads, (ii) cleaning the residual amount of ink off the one or more ink jet heads, and (iii) marking an indication on the print medium at or near the first portion of the print medium, wherein the indication identifies the preprinted information located on the first portion of the print medium as being distinct from the information located on the second portion of the print medium, and wherein the printer marks the indication on the print medium at or near the first portion of the print medium using the residual amount of ink cleaned off the one or more ink jet heads.

2. The method of claim 1, wherein the printer marking the indication on the print medium at or near the first portion of the print medium comprises the printer stamping a mark on a side of the print medium that includes the preprinted information.

3. The method of claim 1, wherein:

receiving, by the printer, an input indicating that the print medium contains preprinted information prior to the printer marking the indication at or near the first portion of the print medium.

4. The method of claim 1, further comprising sensing the preprinted information located on the first portion of the print medium prior to the printer marking the indication on the print medium at or near the first portion of the print medium.

5. The method of claim 1, wherein:

the first portion is located on a first surface of the print medium; and the printer depositing ink, via the one or more ink jet heads, to print the information on the second portion of the print medium comprises the printer depositing ink, via the one or more ink jet heads, to print the information on a second surface of the print medium, wherein the second surface is opposite to the first surface.

6. The method of claim 5, wherein:

the printer comprises a dual-sided printer;

the method further comprises routing the print medium through the dual-sided printer to flip the print medium to allow for the depositing of ink, via the one or more ink jet heads, to print the information on the second surface subsequent to the marking of the indication on the print medium at or near the first portion of the print medium.

7. The method of claim 5, wherein:

the printer comprises a dual-sided printer;

the method further comprises routing the print medium through the dual-sided printer to flip the print medium to allow for the marking of the indication on the print medium at or near the first portion of the print medium subsequent to printing depositing ink, via the one or more ink jet heads, to print the information on the second surface.

8. The method of claim 5, wherein:

the printing apparatus comprises a single-sided printer having a document feed path;

the printing apparatus marking the indication on the print medium at or near the first portion of the print medium comprises marking at or near the first portion of the print medium with a first printing mechanism located along a first side of the document feed path; and the printing apparatus printing information on the print medium on a second portion of the print medium comprises printing with a second printing mechanism located along a second side of the document feed path.

9. A printer for printing information on a print medium that includes preprinted information located on a first portion, the printing apparatus comprising:

a document feed path;

a first printing mechanism adjacent to the document feed path, wherein the first printing mechanism comprises one or more ink jet heads configured to deposit ink onto the print medium in order to print the information on the print medium;

a cleaning mechanism to clean a residual amount of ink from the one or more ink jet heads of the first printing mechanism; and a controller configured to cause the first printing mechanism to (i) print the information on a second portion of the print medium, wherein the second portion is different from the first portion, and (ii) mark an indication on the print medium at or near the first portion of the print medium using the residual amount of ink cleaned from the one or more ink jet heads of the first printing mechanism, wherein the indication identifies the preprinted information located on the first portion of the print medium as being distinct from the information located on the second portion of the print medium.

10. The printer of claim 9, further comprising a second printing mechanism in the form of an automated stamp configured to mark the indication at or near the first portion of the print medium instead of the first printing mechanism.

11. The printer of claim 10, further comprising a pad configured to provide ink for the automated stamp, the residual amount of ink cleaned from the one or more ink jet heads is provided to the pad to provide ink for the stamp.

12. The printer of claim 9, wherein:

the first printing mechanism further comprises a marking device configured to mark the first portion of the print medium; and the residual amount of ink cleaned from the ink jet heads is provided to the marking device.

13. The printer of claim 9, wherein:

the printer comprises a dual-sided printer; and the printer is configured to route the print medium through the printer and flip the print medium so that the print medium passes the first printing mechanism twice such that (i) during one pass the first printing mechanism marks the indication at or near the first portion of the print medium to identify the first portion and (ii) during another pass the first printing mechanism prints the information on the second portion of the print medium.

14. The printing apparatus of claim 9, wherein:

the printing apparatus comprises a single sided printer;

the printing apparatus further comprises a second printing mechanism located along the document feed path; and the printing apparatus is further configured to (i) print, with the first printing mechanism, the information on the second portion of the print medium and (ii) mark, with the second printing mechanism, the indication at or near the first portion of the print medium as the print medium moves along the document feed path.

15. The printer of claim 9, wherein:

the controller is further configured to receive an input indicating that the print medium contains preprinted information.

16. The printer of claim 9, further comprising a sensor configured to sense the preprinted information located on the first portion of the print medium.

17. A printer for printing information on a print medium that includes preprinted information located on a first portion of the print medium, the printer comprising:

a document feed path;

a printing mechanism adjacent to the document feed path; and a controller configured to cause the printing mechanism to (i) print information on a second portion of the print medium, wherein the second portion is different from the first portion, (ii) clean used toner from a drum of the printer, and (iii) mark an indication on the print medium using the used toner at or near the first portion of the print medium, wherein the indication identifies the preprinted information located on the first portion of the print medium as being distinct from the information located on the second portion of the print medium.

* * * * *